US011071390B1

(12) United States Patent
Prewitt et al.

(10) Patent No.: US 11,071,390 B1
(45) Date of Patent: Jul. 27, 2021

(54) ROLLING WORK PLATFORM ASSEMBLY

(71) Applicants: Gary Prewitt, San Antonio, TX (US); Esteban Trevino, Kerens, TX (US)

(72) Inventors: Gary Prewitt, San Antonio, TX (US); Esteban Trevino, Kerens, TX (US)

( * ) Notice: Subject to any disclaimer, the term of this patent is extended or adjusted under 35 U.S.C. 154(b) by 0 days.

(21) Appl. No.: 17/065,877

(22) Filed: Oct. 8, 2020

(51) Int. Cl.

| | |
|---|---|
| ***A47C 16/04*** | (2006.01) |
| ***B25H 5/00*** | (2006.01) |
| ***A47C 3/28*** | (2006.01) |
| ***A47C 7/72*** | (2006.01) |
| ***A47C 7/62*** | (2006.01) |

(52) U.S. Cl.
CPC ..... *A47C 16/04* (2013.01); *A47C 3/28* (2013.01); *A47C 7/624* (2018.08); *A47C 7/725* (2013.01); *B25H 5/00* (2013.01)

(58) Field of Classification Search
CPC .. B25H 5/00; A47C 16/04; A47C 9/02; A47C 7/725; A47C 7/624; A47C 3/28; A47C 7/00
USPC ..... 280/32.6, 32.5; 297/423.41, 188.21
See application file for complete search history.

(56) References Cited

U.S. PATENT DOCUMENTS

| | | | | |
|---|---|---|---|---|
| 3,976,155 | A | 8/1976 | Esch | |
| 4,798,264 | A * | 1/1989 | Miller | A47C 16/04 182/228.1 |
| D330,957 | S * | 11/1992 | Contrini | 280/32.6 |
| 5,427,391 | A * | 6/1995 | Cooper | A63C 17/0026 280/11.19 |
| 5,503,415 | A * | 4/1996 | Powell | B25H 5/00 280/32.6 |
| 5,586,804 | A * | 12/1996 | Burroughs | A47C 7/70 297/188.08 |
| 5,870,774 | A * | 2/1999 | Legenstein | A41D 13/065 2/24 |
| 6,302,413 | B1 | 10/2001 | Comeaux | |
| 6,902,174 | B2 * | 6/2005 | Hernandez | B25H 5/00 280/32.6 |
| D522,261 | S | 6/2006 | Whiteside | |
| 7,070,241 | B2 | 7/2006 | Saulnier | |
| 8,632,231 | B1 * | 1/2014 | McCullough | B25H 5/00 362/486 |
| 9,701,010 | B2 | 7/2017 | Manjarres | |
| 10,220,245 | B1 * | 3/2019 | Halen | A63B 22/203 |
| 2003/0168889 | A1 | 9/2003 | Voyce | |
| 2004/0262869 | A1 | 12/2004 | Reining | |
| 2006/0277643 | A1 * | 12/2006 | Legenstein | A63C 17/0026 2/24 |

FOREIGN PATENT DOCUMENTS

| | | | | |
|---|---|---|---|---|
| FR | 2862324 A1 * | 5/2005 | | A47C 9/005 |
| KR | 2004046634 A * | 6/2004 | | A47C 3/28 |

* cited by examiner

*Primary Examiner* — Milton Nelson, Jr.

(57) ABSTRACT

A rolling work platform assembly that allows rolling while in a kneeling position includes a first plate. A pair of knee pads and a seating unit are selectively engageable to the first plate. The knee pads cushion the knees of a user kneeling upon, or separated from, the first plate. The seating unit engages and pads buttocks of the user kneeling upon the first plate. A set of first wheels engaged to a lower face of the first plate facilitates locomotion of the first plate and the user positioned thereupon.

20 Claims, 11 Drawing Sheets

ROLLING WORK PLATFORM ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to work platform assemblies and more particularly pertains to a new work platform assembly that allows rolling while in a kneeling position.

(2) Description of Related Art Including Information Disclosed Under 37 CFR 1.97 and 1.98

The prior art relates to work platform assemblies, which may comprise wheeled platforms, seats, and knee pads.

BRIEF SUMMARY OF THE INVENTION

An embodiment of the disclosure meets the needs presented above by generally comprising a first plate. A pair of knee pads and a seating unit are selectively engageable to the first plate. The knee pads are configured to cushion the knees of a user kneeling upon, or separated from, the first plate. The seating unit is configured to engage and to pad buttocks of the user kneeling upon the first plate. A set of first wheels is engaged to a lower face of the first plate and is configured to facilitate locomotion of the first plate and the user positioned thereupon.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
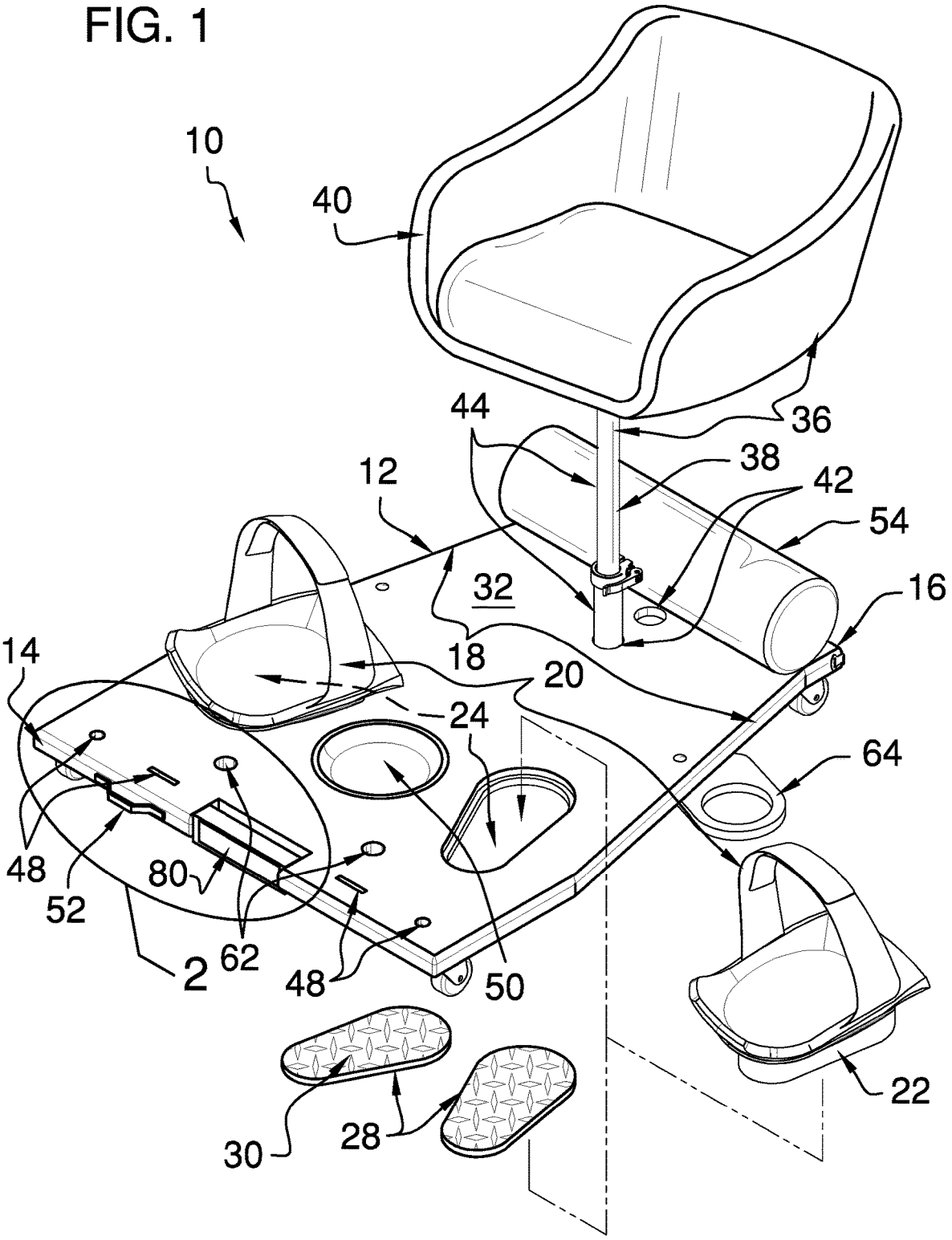
FIG. 1 is an isometric perspective view of a rolling work platform assembly according to an embodiment of the disclosure.

With reference now to the drawings, and in particular to FIGS. 1 through 11 thereof, a new work platform assembly embodying the principles and concepts of an embodiment of the disclosure and generally designated by the reference numeral 10 will be described.

Figure 4:
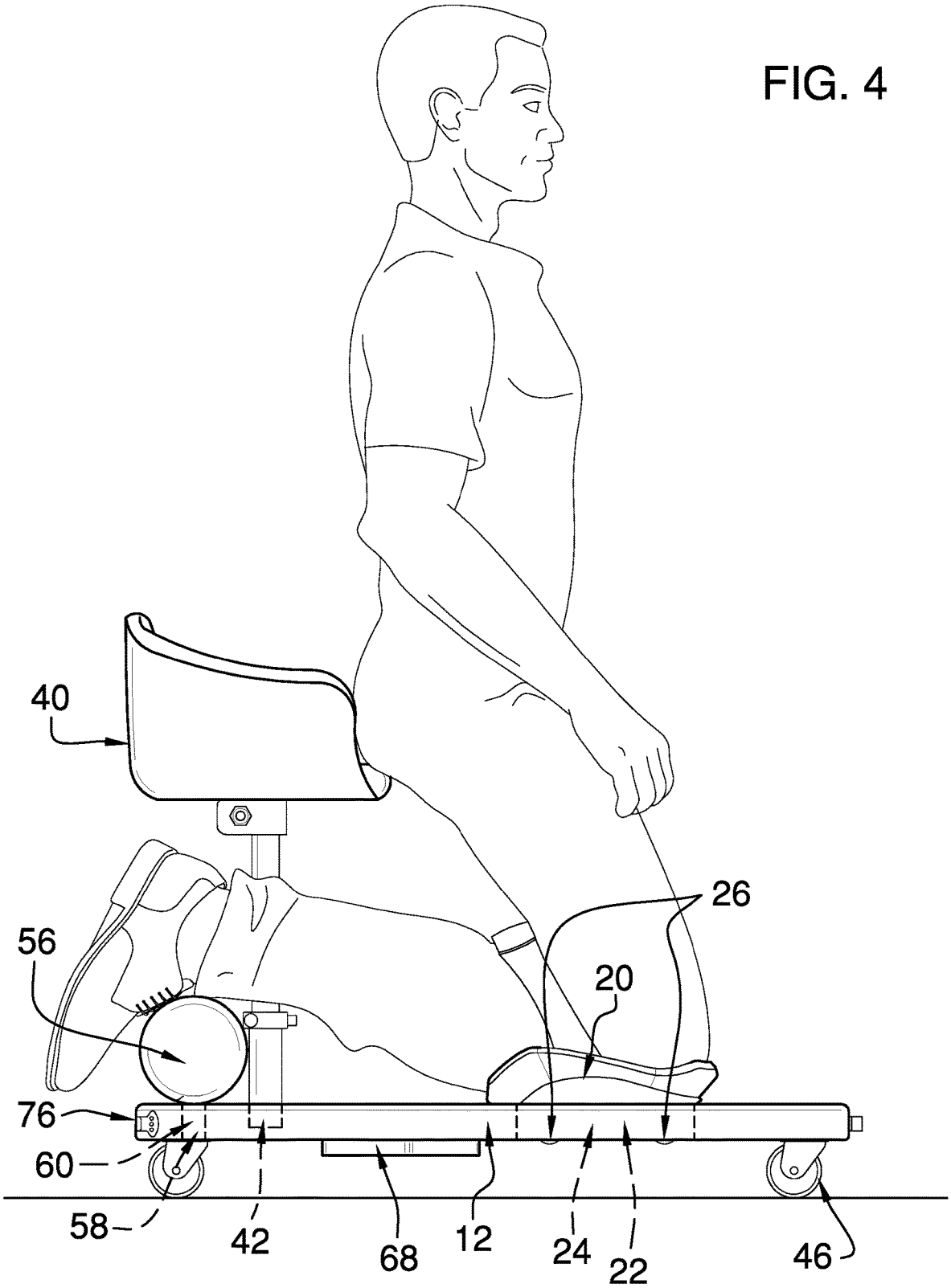
FIG. 4 is an in-use view of an embodiment of the disclosure.
Figure 5:
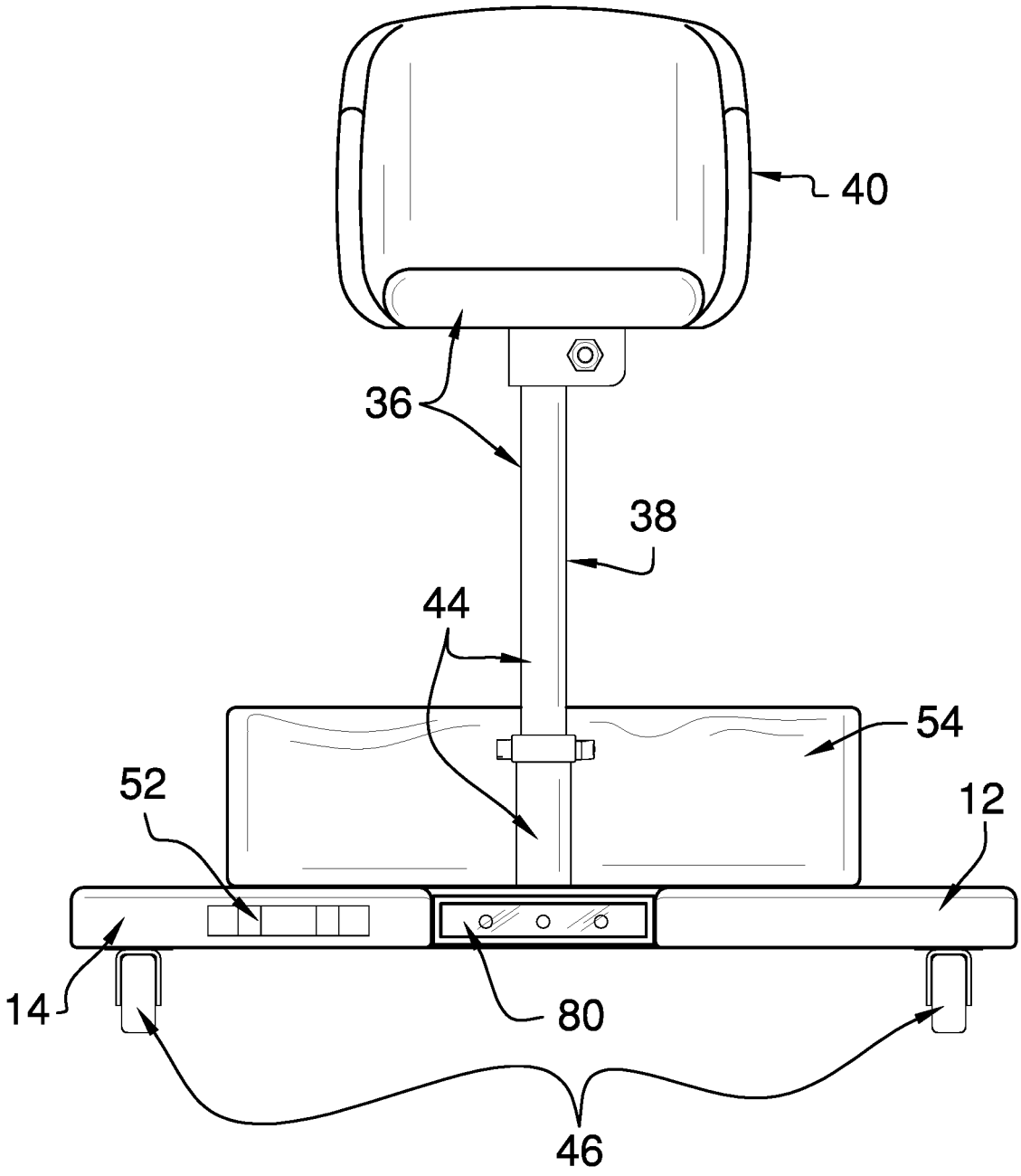
FIG. 5 is a front view of an embodiment of the disclosure.

As best illustrated in FIGS. 1 through 11, the rolling work platform assembly 10 generally comprises a first plate 12, which has a front edge 14, a rear edge 16, and opposed sides 18. The opposed sides 18 taper from proximate to the front edge 14 to the rear edge 16 so that the first plate 12 is dimensionally wider proximate to the front edge 14 than the rear edge 16. The first plate 12 may be substantially planar, as shown in FIG. 5, or it may extend arcuately between the opposed sides 18.

A pair of knee pads 20 is selectively engageable to the first plate 12. The knee pads 20 are configured to cushion the knees of a user kneeling upon, or separated from, the first plate 12. Each knee pad 20 comprises a base 22, which complementary to a respective cutout 24 of a pair of cutouts 24 positioned in the first plate 12 proximate to the front edge 14. The base 22 is selectively insertable into the respective cutout 24 to engage the knee pad 20 to the first plate 12.

The base 22 has a plurality of roller bearings 26 engaged thereto. The roller bearings 26 are configured to facilitate locomotion of the user upon the knee pad 20. Each of a pair of covers 28 is selectively insertable into a respective cutout 24 to engage the cover 28 to the first plate 12 so that an upper limit 30 of the cover 28 is substantially coplanar with an upper face 32 of the first plate 12. The cover 28 is cupped so that a respective base 22 is selectively insertable into the cover 28, from a lower limit 34 thereof, for covering the roller bearings 26.

A seating unit 36 is selectively engageable to the first plate 12. The seating unit 36 is configured to engage and to cushion buttocks of the user kneeling upon the first plate 12. The seating unit 36 comprises a post 38 and a seat 40. The post 38 is selectively positionable in a respective first hole 42 of a set of first holes 42, which are positioned in the first plate 12, to engage the post 38 to the first plate 12. The set of first holes 42 extends perpendicularly from proximate to the rear edge 16 of the first plate 12 and is positioned equally distant from the opposed sides 18 of the first plate 12. The seat 40 is engaged to the post 38 distal from the first plate 12. The post 38 comprises a plurality of nested sections 44 so that the post 38 is selectively extensible.

A set of first wheels 46 is engaged to a lower face 66 of the first plate 12, as shown in FIGS. 4 and 5, and is configured to facilitate locomotion of the first plate 12 and the user positioned thereupon.

Figure 2:
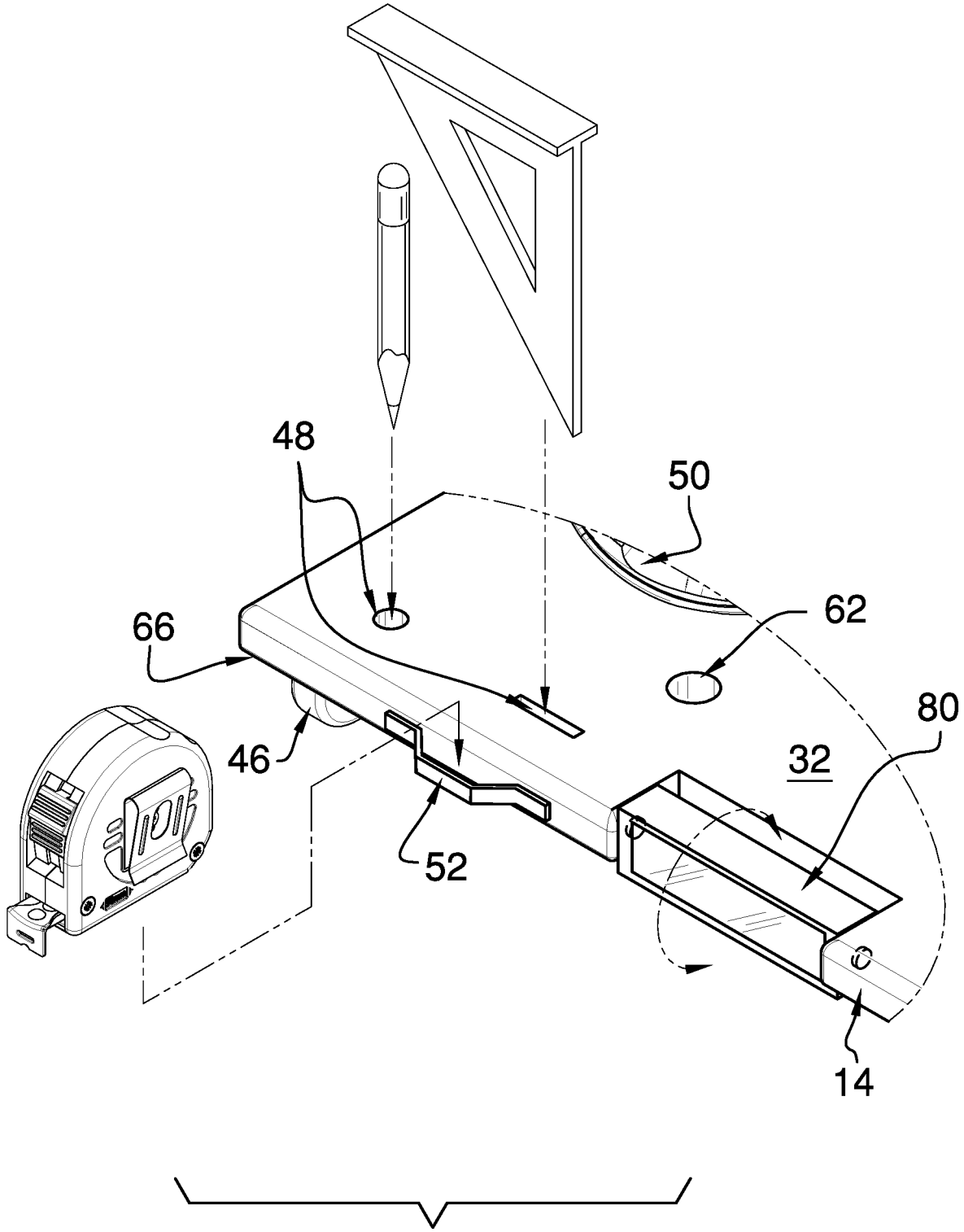
FIG. 2 is a detail view of an embodiment of the disclosure.
Figure 3:
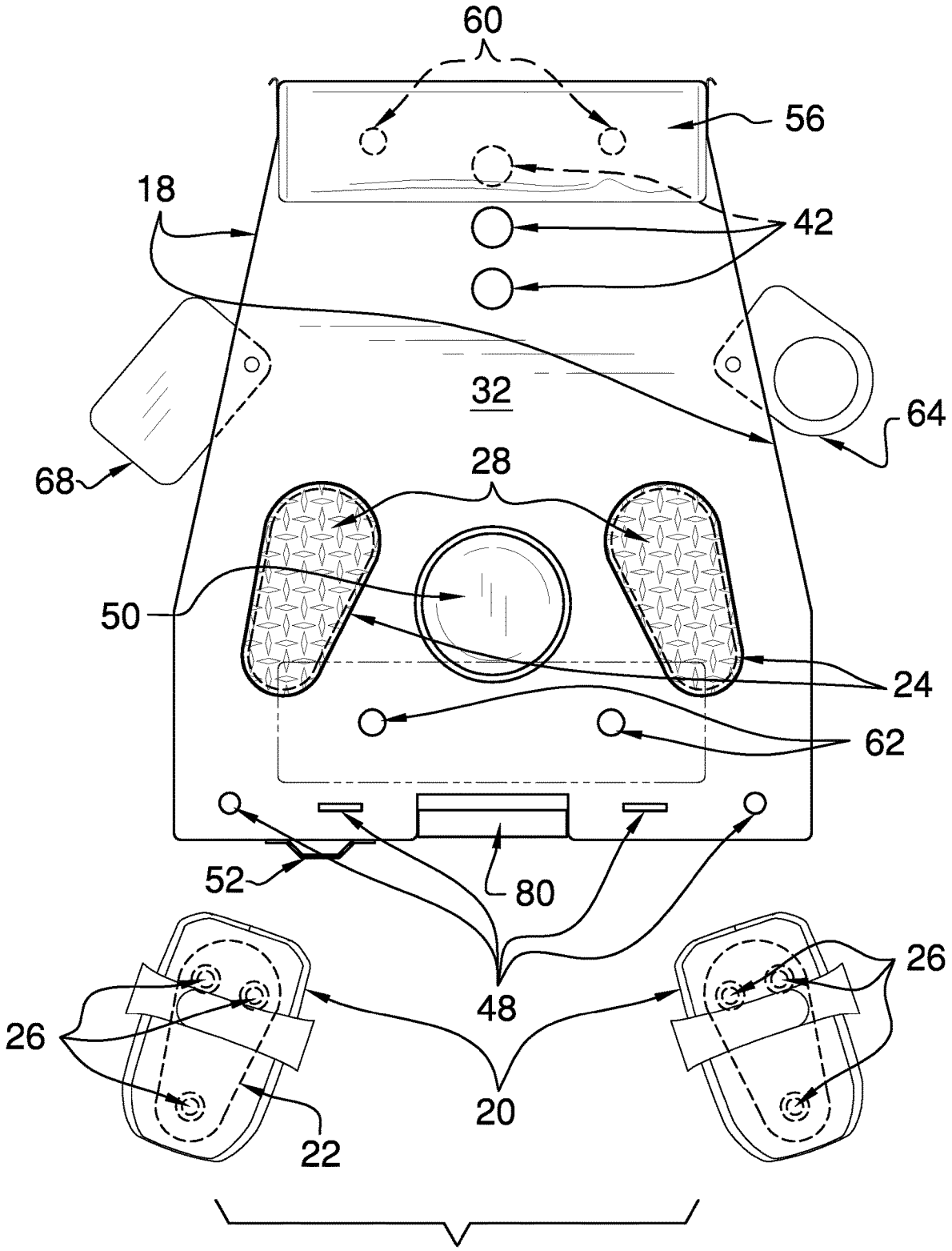
FIG. 3 is a top view of an embodiment of the disclosure.

The first plate 12 has a plurality of apertures 48 positioned therein proximate to the front edge 14, as shown in FIG. 2. Each aperture 48 is configured to selectively engage a respective tool, such as a speed square and a pencil, to removably engage the tool to the first plate 12. The first plate 12 has an indentation 50 positioned therein between the pair of cutouts 24. The indentation 50 is configured to position items, such as screws, bolts, nuts, and the like. A bracket 52 is engaged to the front edge 14 of the first plate 12, as shown in FIG. 2. The bracket 52 is configured to engage a clip of a tool, such as a tape measure, to engage the tool to the first plate 12.

Figure 9:
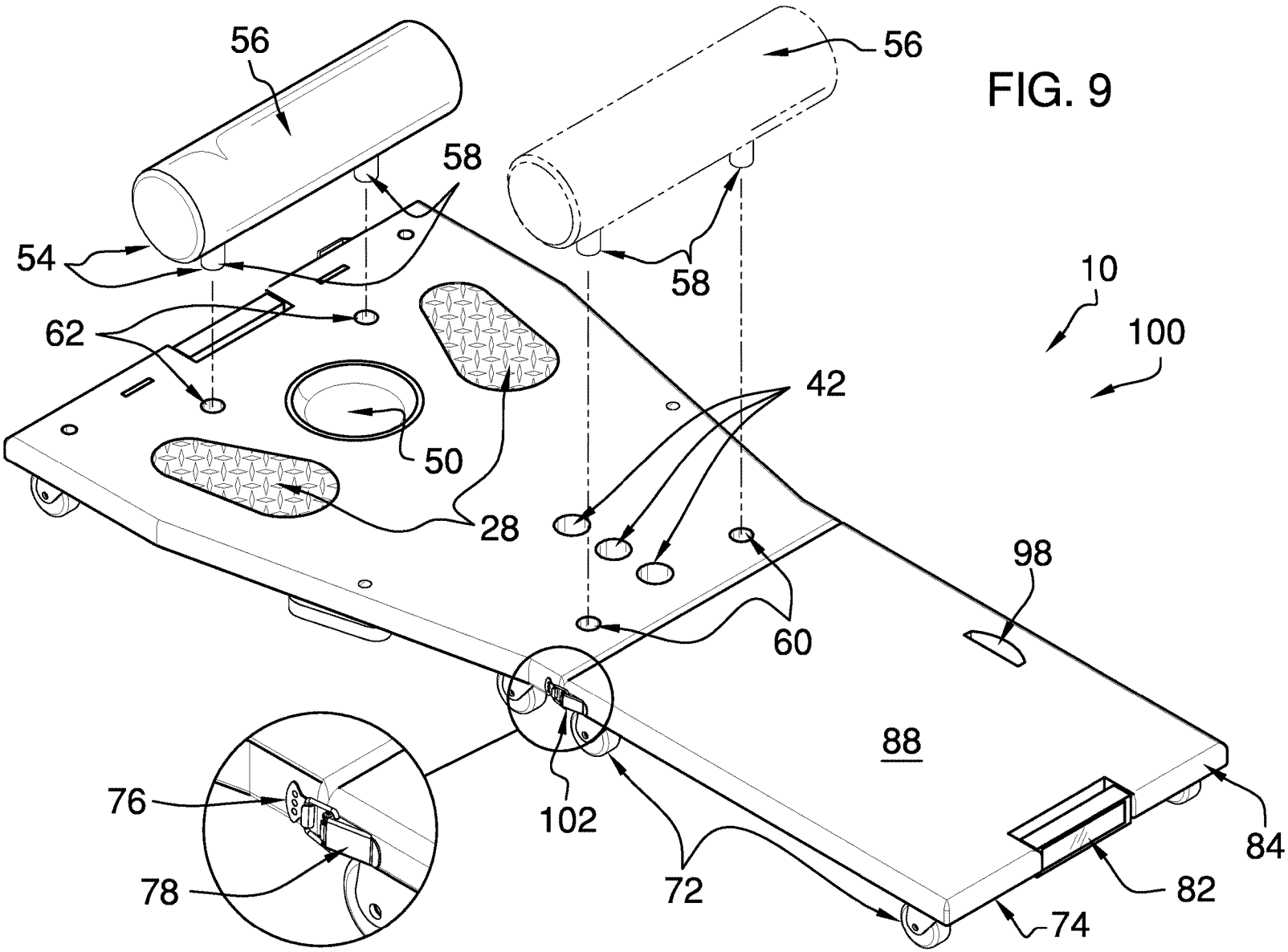
FIG. 9 is an isometric perspective view of an embodiment of the disclosure.

A pillow module 54 selectively couplable to the upper face 32 of the first plate 12 proximate to the rear edge 16 or the front edge 14, as shown in FIG. 9. The pillow module 54 comprises a pad 56 and a pair of rods 58. The pad 56 is cylindrically shaped. The first plate 12 has a pair of second holes 60 and a pair of third holes 62 positioned therein. The pair of second holes 60 is positioned proximate to the rear edge 16. The pair of third holes 62 is positioned proximate to the front edge 14. Each rod 58 of the pair of rods 58 is selectively insertable into a respective second hole 60 or a respective third hole 62, so that the pair of rods 58 is inserted into either the pair of second holes 60 or the pair of third holes 62, to engage the pad 56 to the first plate 12 proximate to the rear edge 16 or the front edge 14, respectively.

Figure 6:
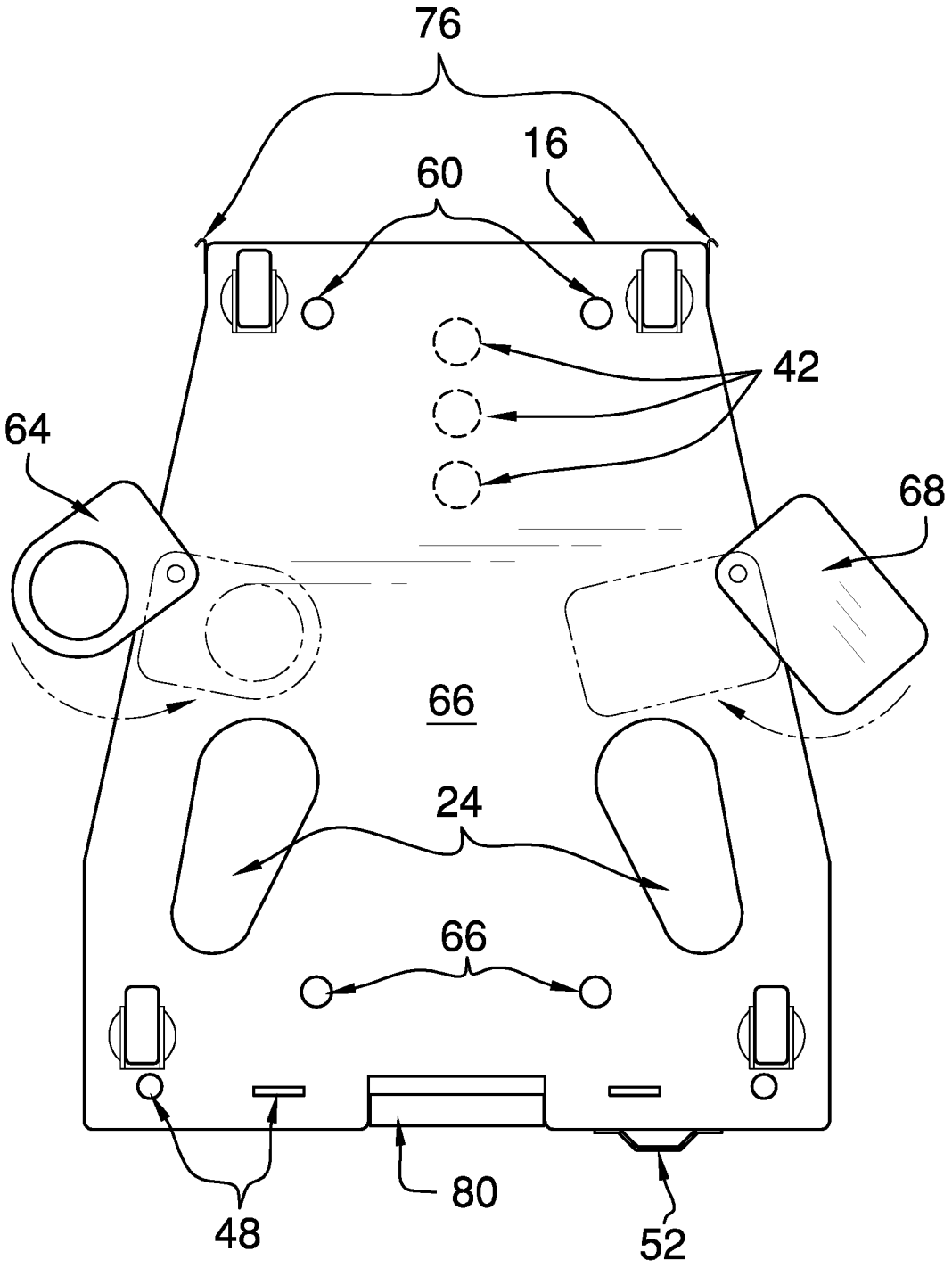
FIG. 6 is a bottom view of an embodiment of the disclosure.
Figure 7:
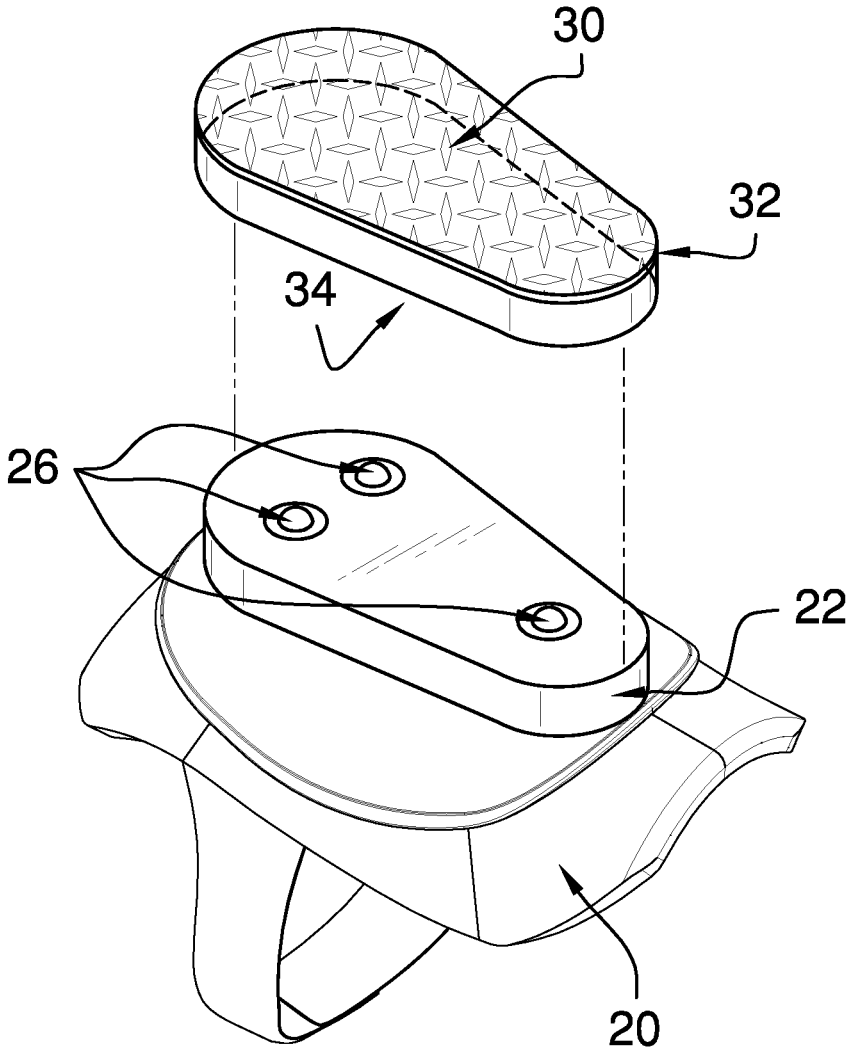
FIG. 7 is a detail view of an embodiment of the disclosure.

A cupholder 64 is rotationally engaged to the lower face 66 of the first plate 12, as shown in FIG. 6. The cupholder 64 is selectively rotatable from a stowed configuration to a deployed configuration. In the stowed configuration, the cupholder 64 is positioned below the first plate 12. In the deployed configuration, the cupholder 64 extends from the first plate 12 and is configured to position a cup.

A side plate 68 is rotationally engaged to the lower face 66 of the first plate 12, as shown in FIG. 6. The side plate 68 is selectively rotatable to a stowed configuration. In the stowed configuration, the side plate 68 is positioned below the first plate 12. In the deployed configuration, the side plate 68 extends from the first plate 12 and is configured for positioned an article. The present invention also anticipates the cupholder 66 and the side plate 68 being slidably engaged to the first plate 12 so that they are selectively slidable between their respective stowed and deployed configurations.

A second plate 70 is selectively engageable to a rear edge 16 of the first plate 12, as shown in FIG. 9. A set of second wheels 72 is engaged to a lower surface 74 of the second plate 70 and is configured to facilitate locomotion of the second plate 70.

A pair of first connectors 76 is engaged to the rear edge 16 of the first plate 12. A pair of second connectors 78 is engaged to the second plate 70 and is complementary to the first connectors 76. Each second connector 78 is positioned to selectively engage a respective first connector 76 to removably engage the second plate 70 to the first plate 12. The second connector 78 and the respective first connector 76 may comprise a toggle latch 102, or other connecting means, such as, but not limited to, buckles, chains, and the like.

A first light 80 is pivotally engaged to a front edge 14 of the first plate 12 and is configured to illuminate an area proximate to the front edge 14 of the first plate 12. A second light 82 pivotally is engaged to a trailing edge 84 of the second plate 70 and is configured to illuminate an area proximate to the trailing edge 84 of the second plate 70.

Figure 10:
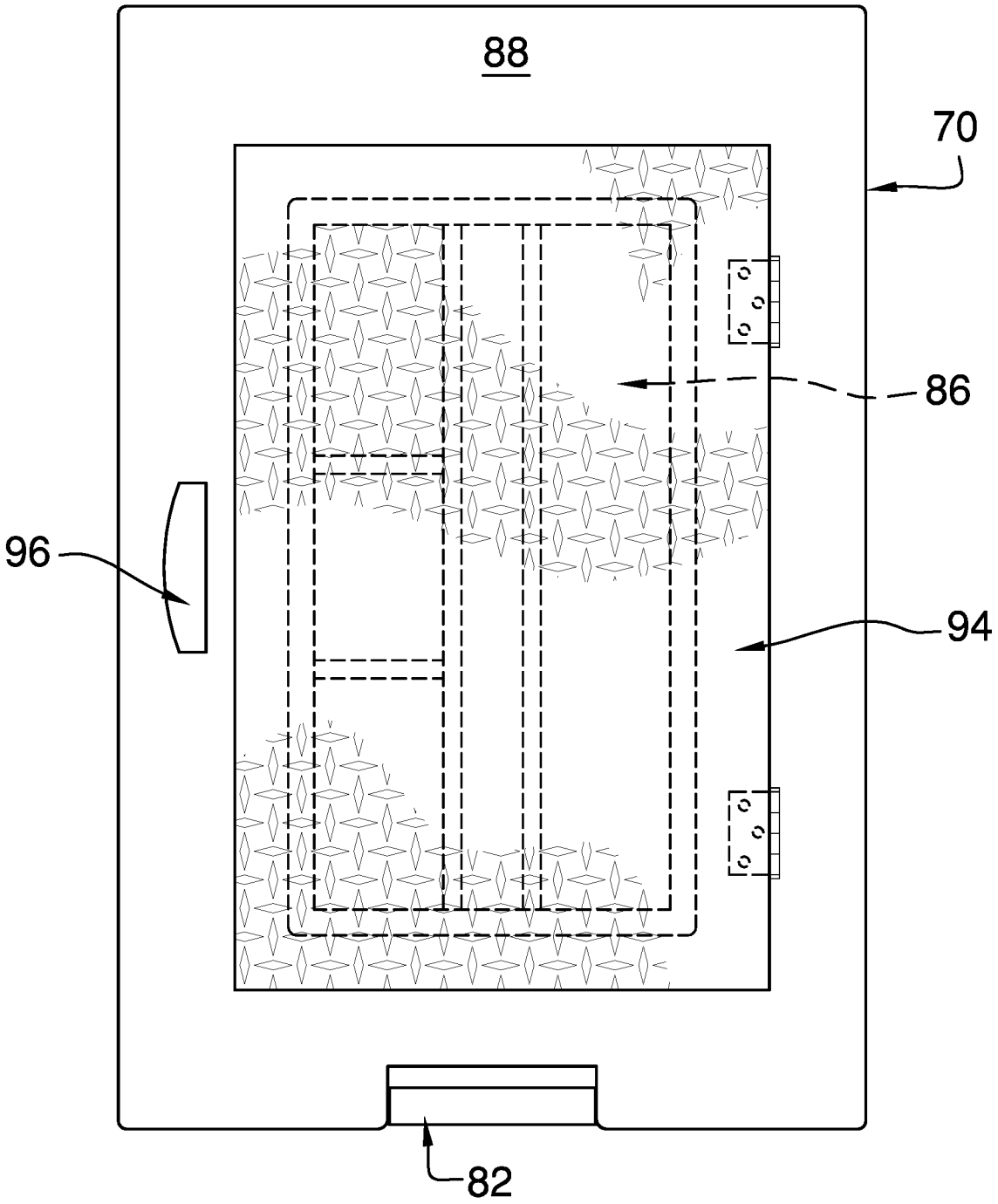
FIG. 10 is a top view of an embodiment of the disclosure.
Figure 11:
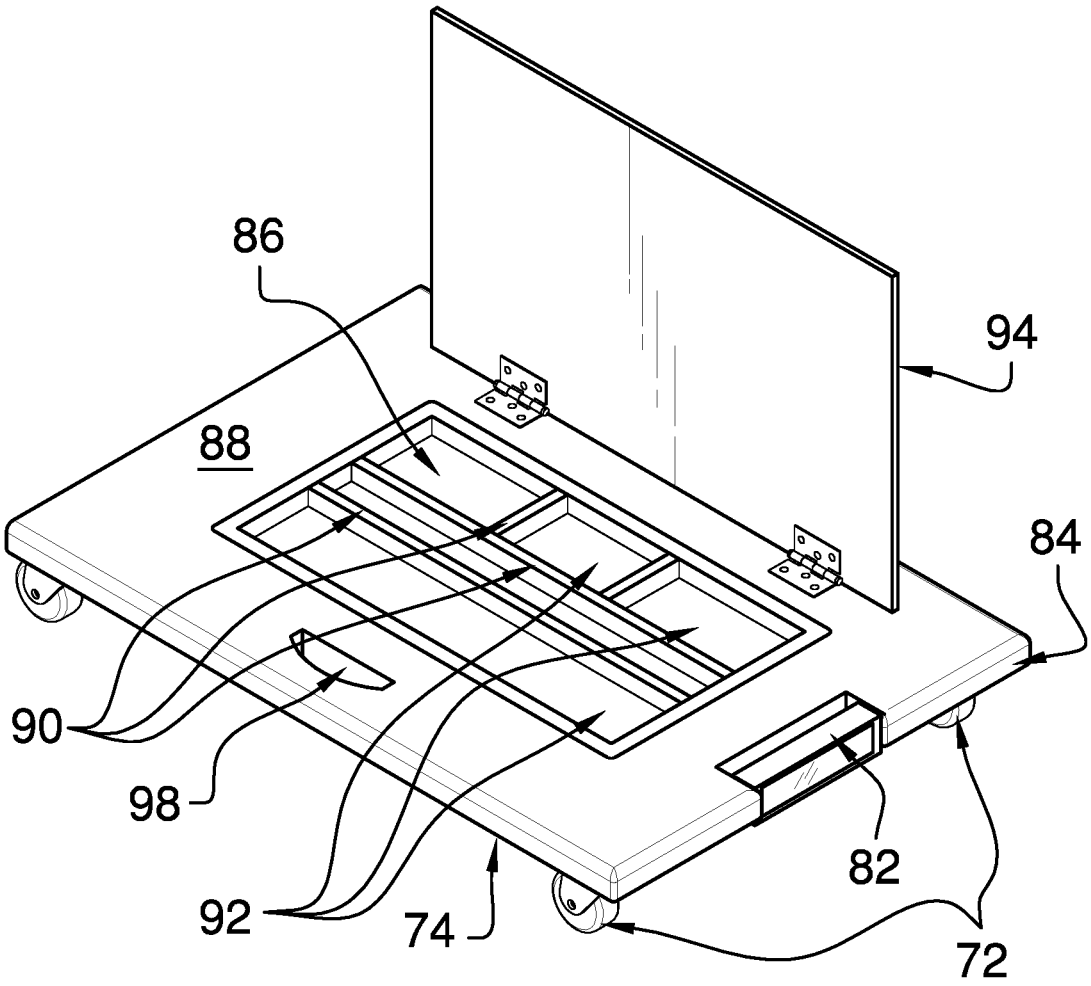
FIG. 11 is an isometric perspective view of an embodiment of the disclosure.

In another embodiment, as shown in FIGS. 10 and 11, the second plate 70 has a recess 86 extending into an upper surface 88 thereof. A plurality of first panels 90 is engaged to the second plate 70 and is positioned in the recess 86 to define a plurality of compartments 92, which are configured to stow articles. A second panel 94 is hingedly engaged to the second plate 70 and is configured to selectively close the recess 86.

Figure 8:
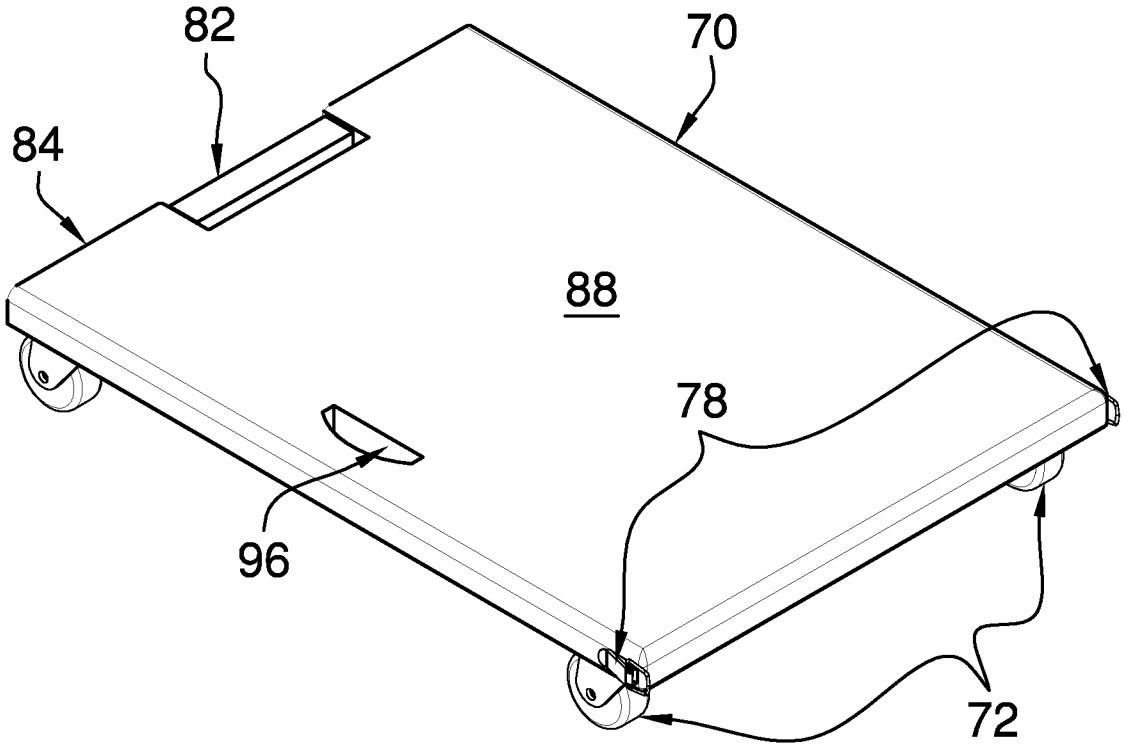
FIG. 8 is an isometric perspective view of an embodiment of the disclosure.

A handle 96 is engaged to the second plate 70, as shown in FIGS. 8 and 10. The handle 96 is configured to be grasped in a hand of a user to lift the second plate 70. The handle 96 comprises a slot 98, which is positioned in the second plate 70 and which is configured for insertion of digits of the hand of the user.

In use, the user positions their knees in the knee pads 20, buttocks on the seat 40, and shins on the pad 56. The user then can locomote the assembly 10 to various work areas as needed. The knee pads 20 can be removed from the first plate 12, allowing the user to use the knee pads 20 independent from the first plate 12. The covers 28 can be removed from the knee pads 20 to allow the user to locomote across a surface upon the roller bearings 26. With the seating unit 36 removed, as shown in FIG. 9, the assembly 10 can be utilized as a creeper 100, such as by an auto mechanic, for accessing an underside of a vehicle.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

We claim:

1. A rolling work platform assembly comprising:

a first plate;

a pair of knee pads selectively engageable to the first plate and being configured for engaging knees of a user, wherein the knee pads are configured for cushioning the knees of a user kneeling upon, or separated from, the first plate;

a seating unit selectively engageable to the first plate and being configured for engaging buttocks of the user, wherein the seating unit is configured for cushioning the buttocks of the user kneeling upon the first plate; and a set of first wheels engaged to a lower face of the first plate, wherein the first wheels are configured for facilitating locomotion of the first plate and the user positioned thereupon.

2. The rolling work platform assembly of claim 1, wherein the first plate has a front edge, a rear edge, and opposed sides, the opposed sides tapering from proximate to the front edge to the rear edge, such that the first plate is dimensionally wider proximate to the front edge than the rear edge.

3. The rolling work platform assembly of claim 1, further including the first plate having a plurality of apertures positioned therein proximate to a front edge thereof, wherein each aperture is configured for selectively engaging a respective tool for removably engaging the tool to the first plate.

4. The rolling work platform assembly of claim 1, wherein the first plate is substantially planar.

5. The rolling work platform assembly of claim 1, further including:

the first plate having a pair of cutouts positioned therein proximate to a front edge thereof; and each knee pad comprising a base, the base being complementary to a respective cutout, such that the base is selectively insertable into the respective cutout for engaging the knee pad to the first plate.

6. The rolling work platform assembly of claim 5, further including the base having a plurality of roller bearings engaged thereto, wherein the roller bearings are configured for facilitating locomotion of the user upon the knee pad.

7. The rolling work platform assembly of claim 6, further including a pair of covers, each cover being selectively insertable into a respective cutout for engaging the first plate, such that an upper limit of the cover is substantially coplanar with an upper face of the first plate; the cover being cupped such that a respective base is selectively insertable into the cover from a lower limit thereof for covering the roller bearings.

8. The rolling work platform assembly of claim 5, further including the first plate having an indentation positioned therein between the pair of cutouts, wherein the indentation is configured for positioning items.

9. The rolling work platform assembly of claim 1, further including:

the first plate having a set of first holes positioned therein, the set of first holes extending perpendicularly from proximate to a rear edge of the first plate and being positioned equally distant from opposed sides of the first plate; and the seating unit comprising a post and a seat, the post being selectively positionable in a respective first hole for engaging the post to the first plate, the seat being engaged to the post distal from the first plate.

10. The rolling work platform assembly of claim 9, wherein the post comprises a plurality of nested sections such that the post is selectively extensible.

11. The rolling work platform assembly of claim 1, further including a pillow module selectively couplable to an upper face of the first plate proximate to a rear edge or a front edge thereof.

12. The rolling work platform assembly of claim 11, further including:

the first plate having a pair of second holes and a pair of third holes positioned therein, the pair of second holes being positioned proximate to the rear edge, the pair of third holes being positioned proximate to the front edge; and the pillow module comprising a pad and a pair of rods, the pad being cylindrically shaped, each rod of the pair of rods being selectively insertable into a respective second hole or a respective third hole, such that the pair of rods is inserted into either the pair of second holes or the pair of third holes, for engaging the pad to the first plate proximate to the rear edge or the front edge, respectively.

13. The rolling work platform assembly of claim 1, further including a bracket engaged to a front edge of the first plate, wherein the bracket is configured for engaging a clip of a tool for engaging the tool to the first plate.

14. The rolling work platform assembly of claim 1, further including:

a cupholder rotationally engaged to the lower face of the first plate, such that the cupholder is selectively rotatable from a stowed configuration, wherein the cupholder is positioned below the first plate, to a deployed configuration, wherein the cupholder extends from the first plate, wherein the cupholder is configured for positioning of a cup; and a side plate rotationally engaged to the lower face of the first plate, such that the side plate is selectively rotatable from a stowed configuration, wherein the side plate is positioned below the first plate, to a deployed configuration, wherein the side plate extends from the first plate, wherein the side plate is configured for positioning an article.

15. The rolling work platform assembly of claim 1, further including:

a second plate selectively engageable to a rear edge of the first plate; and a set of second wheels engaged to a lower surface of the second plate, wherein the second wheels are configured for facilitating locomotion of the second plate.

16. The rolling work platform assembly of claim 15, further including:

a pair of first connectors engaged to the rear edge of the first plate; and a pair of second connectors engaged to the second plate, the second connectors being complementary to the first connectors, such that each second connector is positioned for selectively engaging a respective first connector for removably engaging the second plate to the first plate, the second connector and the respective first connector comprising a toggle latch.

17. The rolling work platform assembly of claim 15, further including:

a first light pivotally engaged to a front edge of the first plate, wherein the first light is configured for illuminating an area proximate to the front edge of the first plate; and a second light pivotally engaged to a trailing edge of the second plate, wherein the second light is configured for illuminating an area proximate to the trailing edge of the second plate.

18. The rolling work platform assembly of claim 15, further including:

the second plate having a recess extending into an upper surface thereof;

a plurality of first panels engaged to the second plate and positioned in the recess defining a plurality of compartments, wherein the compartments are configured for stowing articles; and a second panel hingedly engaged to the second plate and being configured for selectively closing the recess.

19. The rolling work platform assembly of claim 15, further including a handle engaged to the second plate, wherein the handle is configured for grasping in a hand of a user for lifting the second plate, the handle comprising a slot positioned in the second plate, wherein the slot is configured for insertion of digits of the hand of the user.

20. A rolling work platform assembly comprising:

a first plate, the first plate having a pair of cutouts, a set of first holes, a pair of second holes, a pair of third holes, an indentation, and a plurality of apertures positioned therein, the cutouts being positioned proximate to a front edge of the first plate, the set of first holes extending perpendicularly from proximate to a rear edge of the first plate and being positioned equally distant from opposed sides of the first plate, the pair of second holes being positioned proximate to the rear edge, the pair of third holes being positioned proximate to the front edge, the indentation being positioned between the pair of cutouts, wherein the indentation is configured for positioning items, the apertures being positioned proximate to the front edge, wherein each aperture is configured for selectively engaging a respective tool for removably engaging the tool to the first plate, the first plate being substantially planar, the opposed sides tapering from proximate to the front edge to the rear edge, such that the first plate is dimensionally wider proximate to the front edge than the rear edge;

a pair of knee pads selectively engageable to the first plate and being configured for engaging knees of a user, wherein the knee pads are configured for cushioning the knees of a user kneeling upon, or separated from, the first plate, each knee pad comprising a base, the base being complementary to a respective cutout, such that the base is selectively insertable into the respective cutout for engaging the knee pad to the first plate, the base having a plurality of roller bearings engaged thereto, wherein the roller bearings are configured for facilitating locomotion of the user upon the knee pad;

a pair of covers, each cover being selectively insertable into a respective cutout for engaging the first plate, such that an upper limit of the cover is substantially coplanar with an upper face of the first plate, the cover being cupped such that a respective base is selectively insertable into the cover from a lower limit thereof for covering the roller bearings;

a seating unit selectively engageable to the first plate and being configured for engaging buttocks of the user, wherein the seating unit is configured for cushioning the buttocks of the user kneeling upon the first plate, the seating unit comprising a post selectively positionable in a respective first hole for engaging the post to the first plate, the post comprising a plurality of nested sections such that the post is selectively extensible, and a seat engaged to the post distal from the first plate;

a set of first wheels engaged to a lower face of the first plate, wherein the first wheels are configured for facilitating locomotion of the first plate and the user positioned thereupon;

a pillow module selectively couplable to the upper face of the first plate proximate to the rear edge or the front edge thereof, the pillow module comprising:

a pad, the pad being cylindrically shaped, and a pair of rods, each rod of the pair of rods being selectively insertable into a respective second hole or a respective third hole, such that the pair of rods is inserted into either the pair of second holes or the pair of third holes, for engaging the pad to the first plate proximate to the rear edge or the front edge, respectively;

a first light pivotally engaged to the front edge of the first plate, wherein the first light is configured for illuminating an area proximate to the front edge of the first plate;

a bracket engaged to the front edge of the first plate, wherein the bracket is configured for engaging a clip of a tool for engaging the tool to the first plate;

a cupholder rotationally engaged to the lower face of the first plate, such that the cupholder is selectively rotatable from a stowed configuration, wherein the cupholder is positioned below the first plate, to a deployed configuration, wherein the cupholder extends from the first plate, wherein the cupholder is configured for positioning of a cup;

a side plate rotationally engaged to the lower face of the first plate, such that the side plate is selectively rotatable from a stowed configuration, wherein the side plate is positioned below the first plate, to a deployed configuration, wherein the side plate extends from the first plate, wherein the side plate is configured for positioning an article;

a second plate selectively engageable to the rear edge of the first plate, the second plate having a recess extending into an upper surface thereof;

a pair of first connectors engaged to the rear edge of the first plate;

a pair of second connectors engaged to the second plate, the second connectors being complementary to the first connectors, such that each second connector is positioned for selectively engaging a respective first connector for removably engaging the second plate to the first plate, the second connector and the respective first connector comprising a toggle latch;

a set of second wheels engaged to a lower surface of the second plate, wherein the second wheels are configured for facilitating locomotion of the second plate;

a plurality of first panels engaged to the second plate and positioned in the recess defining a plurality of compartments, wherein the compartments are configured for stowing articles;

a second panel hingedly engaged to the second plate and being configured for selectively closing the recess;

a handle engaged to the second plate, wherein the handle is configured for grasping in a hand of a user for lifting the second plate, the handle comprising a slot positioned in the second plate, wherein the slot is configured for insertion of digits of the hand of the user; and a second light pivotally engaged to a trailing edge of the second plate, wherein the second light is configured for illuminating an area proximate to the trailing edge of the second plate.

* * * * *